US005429063A

United States Patent [19]

Rosenkranz

[11] Patent Number: 5,429,063

[45] Date of Patent: Jul. 4, 1995

[54] DOCKING DEVICE

[76] Inventor: Walter E. Rosenkranz, 3248 Blackhawk Meadow Dr., Danville, Calif. 94506

[21] Appl. No.: 216,291

[22] Filed: Mar. 23, 1994

[51] Int. Cl.[6] ..... E02B 3/26

[52] U.S. Cl. ..... 114/220; 405/213

[58] Field of Search ..... 114/220, 230, 219; 405/213, 214; 267/139; 293/125

[56] References Cited

U.S. PATENT DOCUMENTS

| | | | |
|---|---|---|---|
| 1,182,400 | 5/1916 | Montanari . | |
| 1,583,636 | 5/1926 | Williams | 293/125 X |
| 2,900,946 | 8/1959 | Walker | 114/220 |
| 3,084,517 | 4/1963 | Bell . | |
| 3,120,831 | 2/1964 | Fulton | 114/230 |
| 3,145,685 | 8/1964 | Kulick, Sr. | 114/220 |
| 3,163,410 | 12/1964 | Reid | 114/220 |
| 3,373,714 | 3/1968 | Hart | 114/230 |
| 4,478,536 | 10/1984 | Drewett et al. | 405/213 |
| 5,113,702 | 5/1992 | Capps | 114/219 |

FOREIGN PATENT DOCUMENTS

| | | |
|---|---|---|
| 3-231094A | 10/1991 | Japan . |
| 3-273993A | 12/1991 | Japan . |

*Primary Examiner*—Sherman Basinger

*Attorney, Agent, or Firm*—Richard C. Litman

[57] ABSTRACT

The instant invention provides a docking device for a boat, which may include a pair of docking elements. Each docking element includes a vessel contacting element or wheel that may be retained between an upper wheel holder and a lower wheel holder. A spring element may be made any suitable material that is resistant to ultraviolet (UV) radiation, waterproof and salt-resistant. The spring element includes a first leg, which may be fastened to a sidewall of the dock and a second leg. The spring element may be straight or may include an angled portion. A wheel may be rotatably attached to the spring element by an upper wheel holder and a lower wheel holder. A first edge of the spring element may be received within a slot in the upper wheel holder, and second edge of the spring element may be received within a slot in the lower wheel holder. An angled spring element may be used, when the width of the boat does not closely match the width of the dock area. To compensate for a large discrepancy between the width of the boat and the docking area, an included angle up to 90° may be utilized. An alternative embodiment of the docking device may include a pivot base having a plurality of bosses with angled faces and a pivot arm for carrying a wheel that contacts a boat. A spring may bias the pivot arm away from the pivot base.

12 Claims, 9 Drawing Sheets

DOCKING DEVICE

BACKGROUND OF THE INVENTION

1. Field of the Invention

The present invention relates to a docking device for aiding in docking a boat, more particularly, to a resilient docking device contacting a boat and flexing in response to wave action and the motion of the boat.

2. Description of the Prior Art

Docking devices and boat guards for guiding a boat into a dock and protecting a boat, when docked, have been proposed. However, the prior devices are cumbersome and have many moving parts.

U.S. Pat. No. 1,182,400 issued to Angelo Montanari on May 9, 1916 discloses a buffer for ships including a plurality of buffer wheels for contacting a ship. U.S. Pat. No. 2,900,946 issued to Dunaway Walker on Aug. 25, 1959 discloses a boat fender or bumper for use in receiving the thrust of a water craft during berthing, tying a boat to a dock or tying a boat to another boat.

U.S. Pat. No. 3,084,517 issued to Currie Bell on Apr. 9, 1963 discloses a dock attachment or bumper device including a roller 26 urged toward a boat by compression spring 21. U.S. Pat. No. 3,145,685 issued to Edward Kulick, Sr. on Aug. 25, 1964 discloses a shock absorbing bumper for boats and docks including a plurality of rollers 20. U.S. Pat. No. 4,478,536 issued to Glen Drewett on Oct. 23, 1984 discloses an adjustable length shock absorbing arrangement for a marine structure.

U.S. Pat. No. 5,113,702 issued to Lloyd Capps on May 19, 1992 discloses a boat and dock guard for use to store a boat therein. According to the Capps device, first and second intermediate guards may be used to direct a boat to a pair of padded stop members secured to a dock front.

Tokuaki Tanaka in Japanese patent document 3-273993 A dated Oct. 15, 1991 discloses a device for shortening the positioning time of a leisure boat. The device is described as including rubber rollers which engage the sides of a boat. Tokuaki Tanaka in Japanese patent document 3-231094 A dated Dec. 5, 1991 discloses a device for positioning a boat in a landing pier. A plurality of air bags 2 may contact the boat.

None of the above inventions and patents, taken either singly or in combination, is seen to describe the instant invention as claimed.

SUMMARY OF THE INVENTION

The present invention provides a docking device that is inexpensive to manufacture and maintain.

Accordingly, it is a principal object of the invention to provide a docking device with few parts and is durable and easy to install.

It is another object of the invention to provide a docking device with an angled spring element, so a boat contacting wheel projects into a dock area.

It is an object of the invention to provide improved elements and arrangements thereof in an apparatus for the purposes described which is inexpensive, dependable and fully effective in accomplishing its intended purposes.

The instant invention provides a docking device for a boat and may include a pair of docking elements. Each docking element may include a vessel contacting element or wheel. A spring element may be made of any suitable material that is resistant to ultraviolet (UV) radiation, waterproof and salt-resistant. The spring element includes a first leg, which may be fastened to a sidewall of the dock and a second leg. The spring element may be straight or may include an angled portion. A wheel may be rotatably attached to the spring element by an upper wheel holder and a lower wheel holder. A first edge of the spring element may be received within a slot in the upper wheel holder, and a second edge of the spring element may be received within a slot in the lower wheel holder. An angled spring element may be used, when the width of the boat does not closely match the width of the dock area. To compensate for a large discrepancy between the width of the boat and the docking area, an included angle up to 90° may be utilized.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
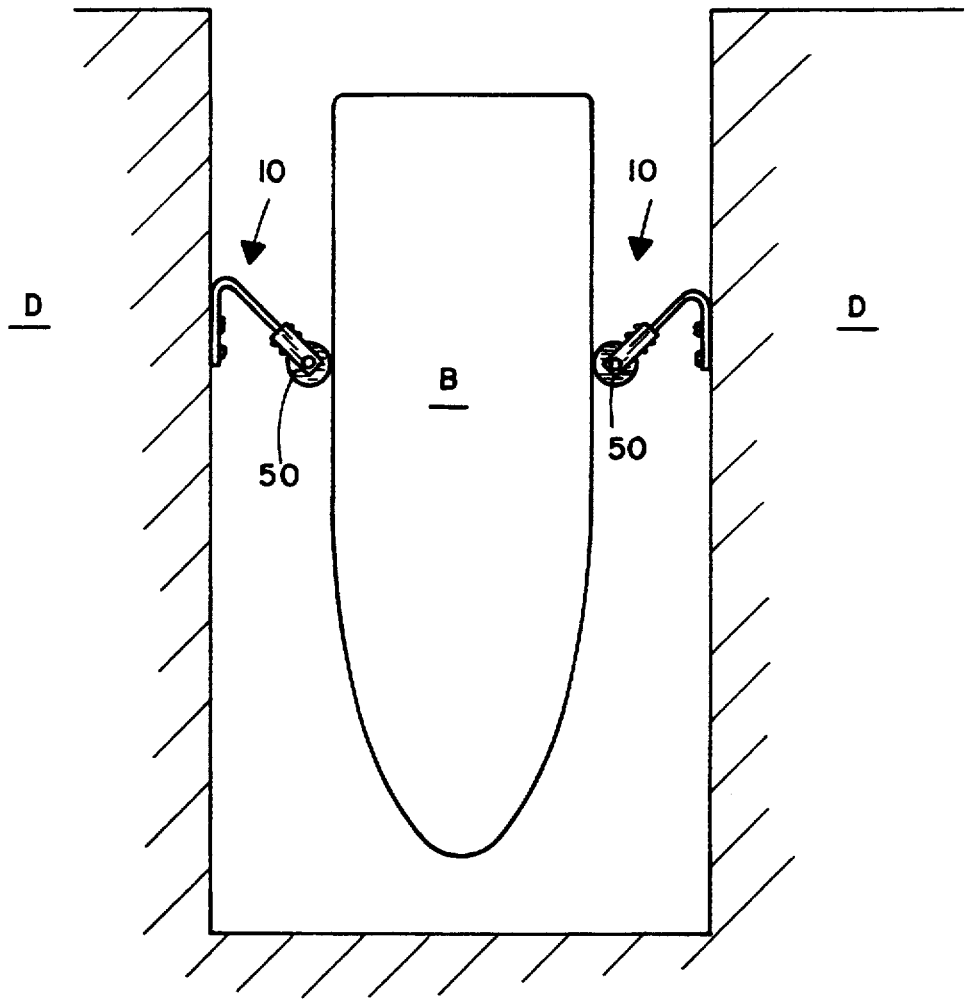
FIG. 1 is an environmental top plan view of a boat supported in a dock by two docking devices according to a first embodiment of the invention.
Figure 2:
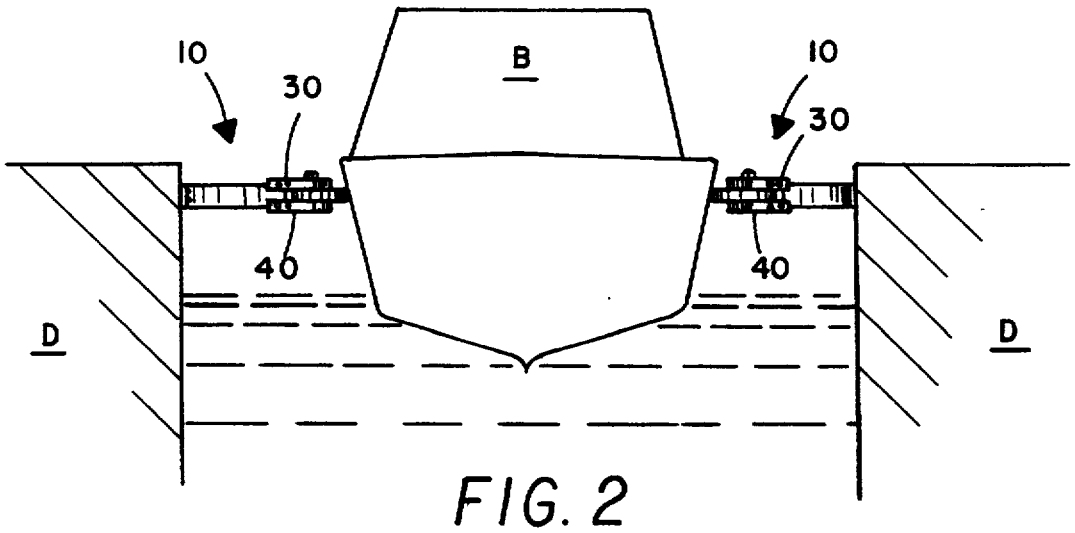
FIG. 2 is an environmental side view in elevation of a boat supported in a dock by the two docking devices of FIG. 1.

FIGS. 1 and 2 show a boat B located in a dock D and in contact with two docking devices 10. Docking device 10 includes a vessel contacting element or wheel 50, which is retained between upper wheel holder 30 and lower wheel holder 40.

Figure 3:
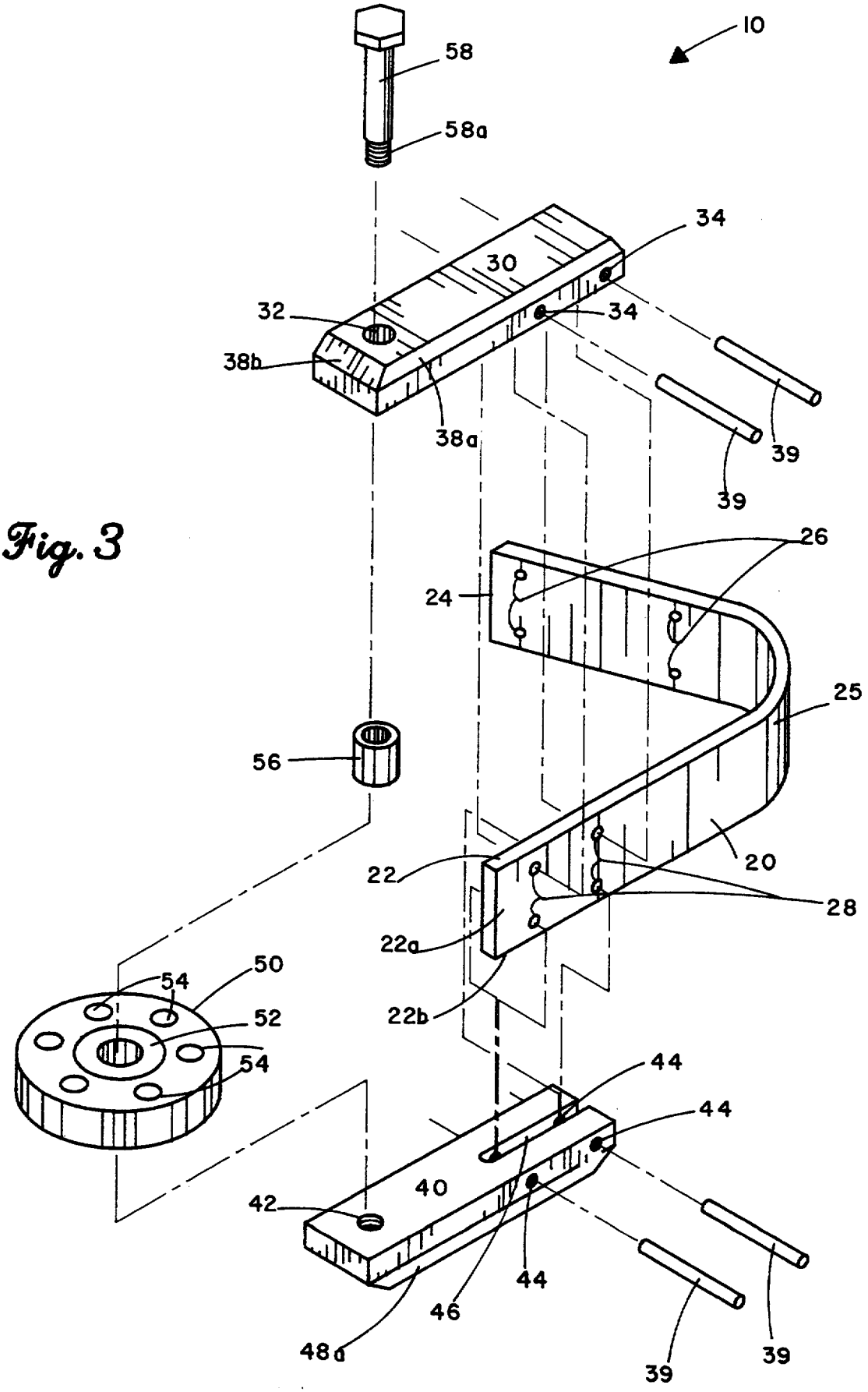
FIG. 3 is an exploded perspective view of the docking device of FIG. 1 including a spring element having a 45° bend.

FIG. 3 shows an exploded perspective view of a first embodiment of the docking device 10 according to the invention. Spring element 20 may be made from polycarbonate according to the preferred embodiment. The spring element may be formed from any suitable material that is resistant to ultraviolet (UV) radiation, waterproof and salt-resistant. Spring element 20 includes first leg 24, which may be bolted to a sidewall of the dock and second leg 22 and an angled portion or bend 25 therebetween. As shown in FIG. 3, bend 25 defines an included angle of 45° with respect to first leg 24 and second leg 22.

A wheel 50 is rotatably attached to spring element 20 by upper wheel holder 30 and lower wheel holder 40. Upper wheel holder 30 may include parallel beveled surfaces 38*a* and parallel beveled surfaces 38*b*. Lower wheel holder 40 may include parallel beveled surfaces 48*a* and parallel beveled surfaces 48*b* (see FIG. 8). The wheel holders may be connected by a bolt 58 having a threaded portion 58*a*. The bolt may be seven inches in length with a ½" nominal diameter and a 13 UNC thread. The bolt passes through a smooth bore 32 in upper wheel holder 30 and is fastened into threaded bore 42 in lower wheel holder 40.

A plastic bushing 56 surrounds bolt 58 and contacts wheel 50. According to the preferred embodiment a rubber wheel is used, and is commercially available from ASTRONAUTICS, Inc. at 162 San Lazaro Avenue, Sunnyvale, Calif. 94086. According to the preferred embodiment the hollow wheel has a 10 inch outer diameter with a recessed portion 52 and a plurality of apertures 54 spaced about the circumference of the wheel. The material that forms the apertures also strengthens the wheel by locating cylindrical portions of additional material between the top and bottom surfaces of the wheel.

When assembled, pins 39 pass through connection bores 34, 44 in the wheel holders and connection bores 28 in spring element 20. In the assembled position, first edge 22*a* of spring element 20 is received within slot 36 (see FIGS. 5 and 6) of upper wheel holder 30, and second edge 22*b* of spring element 20 is received within slot 46 of lower wheel holder 40.

Figure 4:
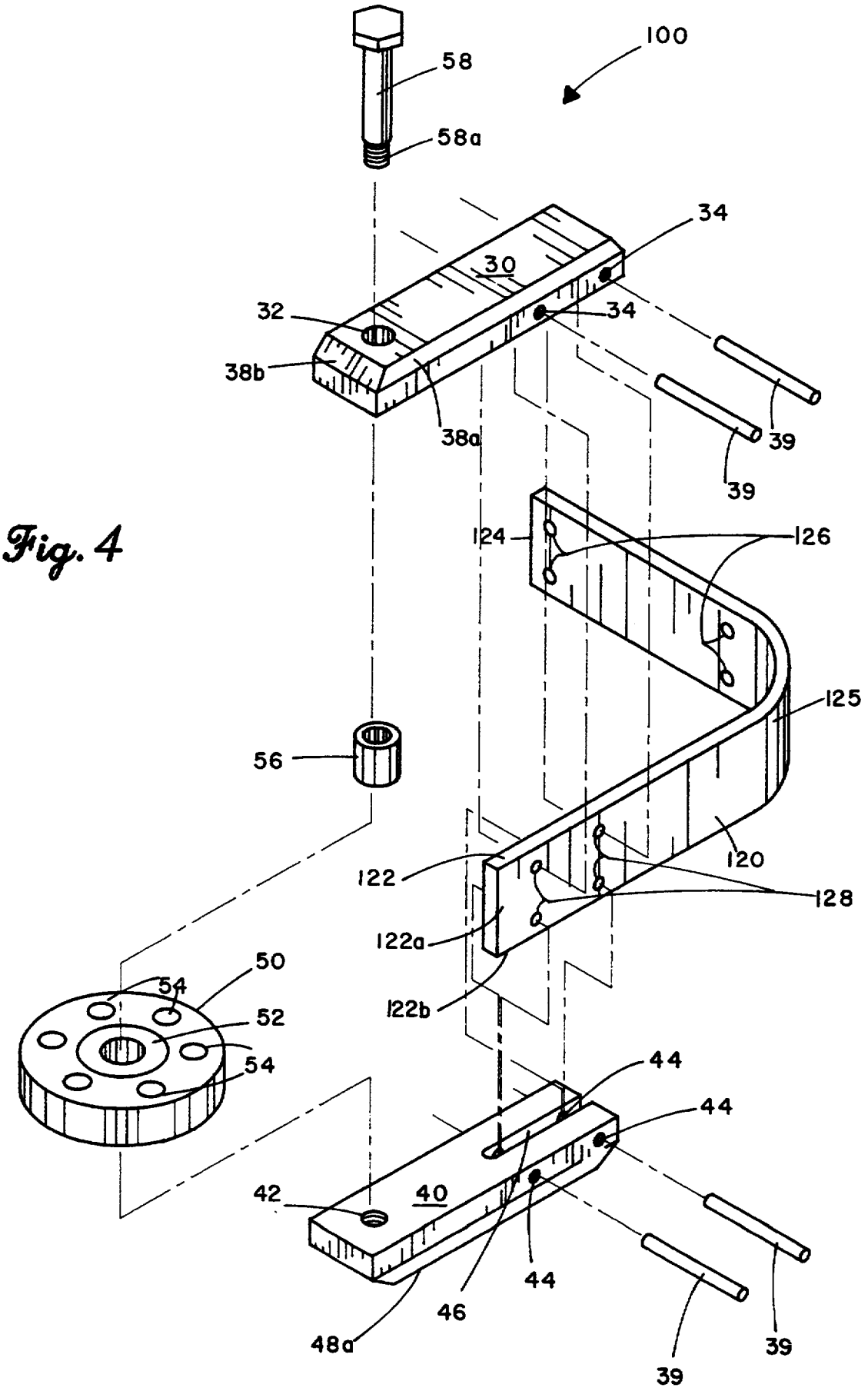
FIG. 4 is an exploded perspective view of a second embodiment of the invention with a spring element having a 90° bend.

FIG. 4 shows a different embodiment of the docking device according to the invention. Docking device 100 includes spring element 120 may be made from polycarbonate or any other material that is UV resistant, waterproof and salt-resistant. The spring element includes first leg 124, which may be bolted to a sidewall of the dock and second leg 122 and an angled portion or bend 125 therebetween. As shown in FIG. 4, bend 125 defines an included angle of 90° with respect to first leg 124 and second leg 122.

An important feature of invention regards the angle of the bend portion. In the event that the width of boat does not closely match the width of the dock area, a larger included angle is necessary. To compensate for a large discrepancy between the width of the boat and the docking area, a larger included angle up to 90° may be utilized. As one of ordinary skill in the art may readily appreciate, a larger included angle of the spring element results in the wheel projecting further into the dock area.

Figure 5:
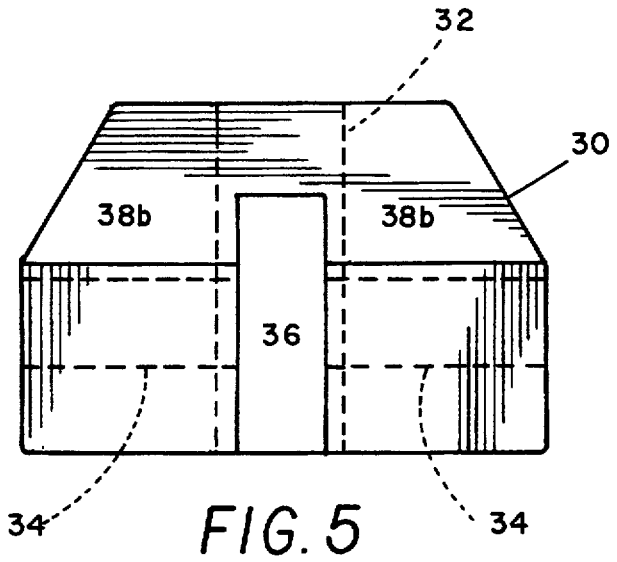
FIG. 5 is an enlarged rear view in elevation of an upper wheel holder of the invention.
Figure 6:
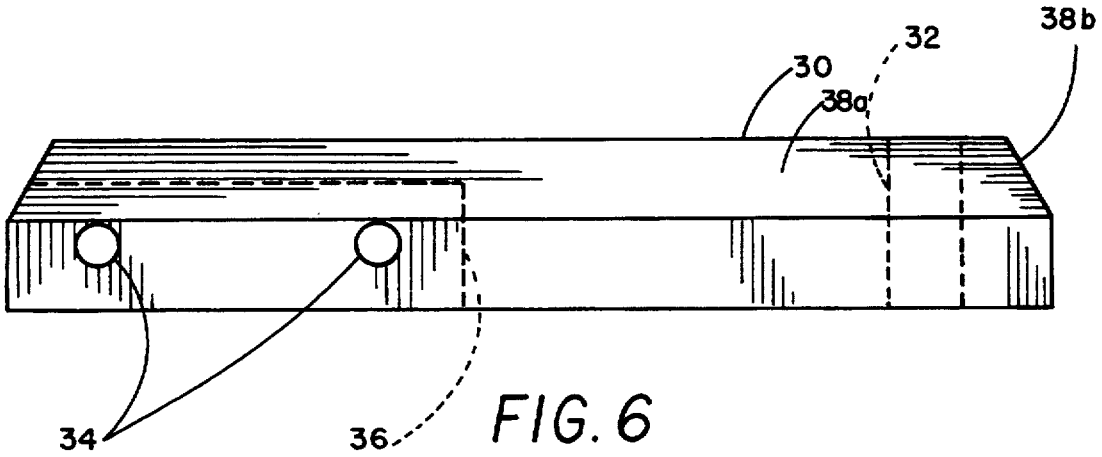
FIG. 6 is a side view in elevation of the upper wheel holder of FIG. 5.
Figure 8:
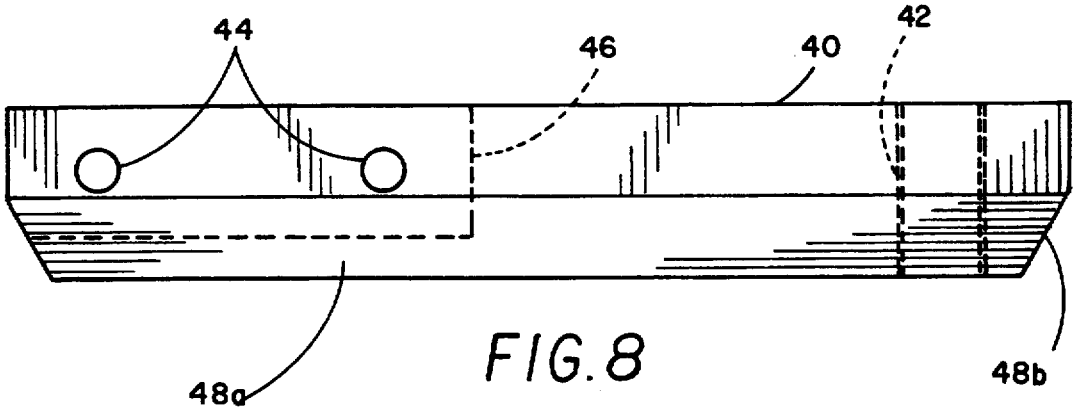
FIG. 8 is a side view in elevation of a lower wheel holder according to the invention.

FIGS. 5, 6 and 8 show various details of upper wheel holder 30 and lower wheel holder 40. As stated above, upper wheel holder 30 may include smooth bore 32, connection bores 34, a slot 36 and parallel beveled surfaces 38*b*. Lower wheel holder 40 may include parallel beveled surfaces 48*a* and parallel beveled surfaces 48*b*. The lower wheel holder further includes threaded bore 42, connection bores 44, and a slot 46.

Figure 7:
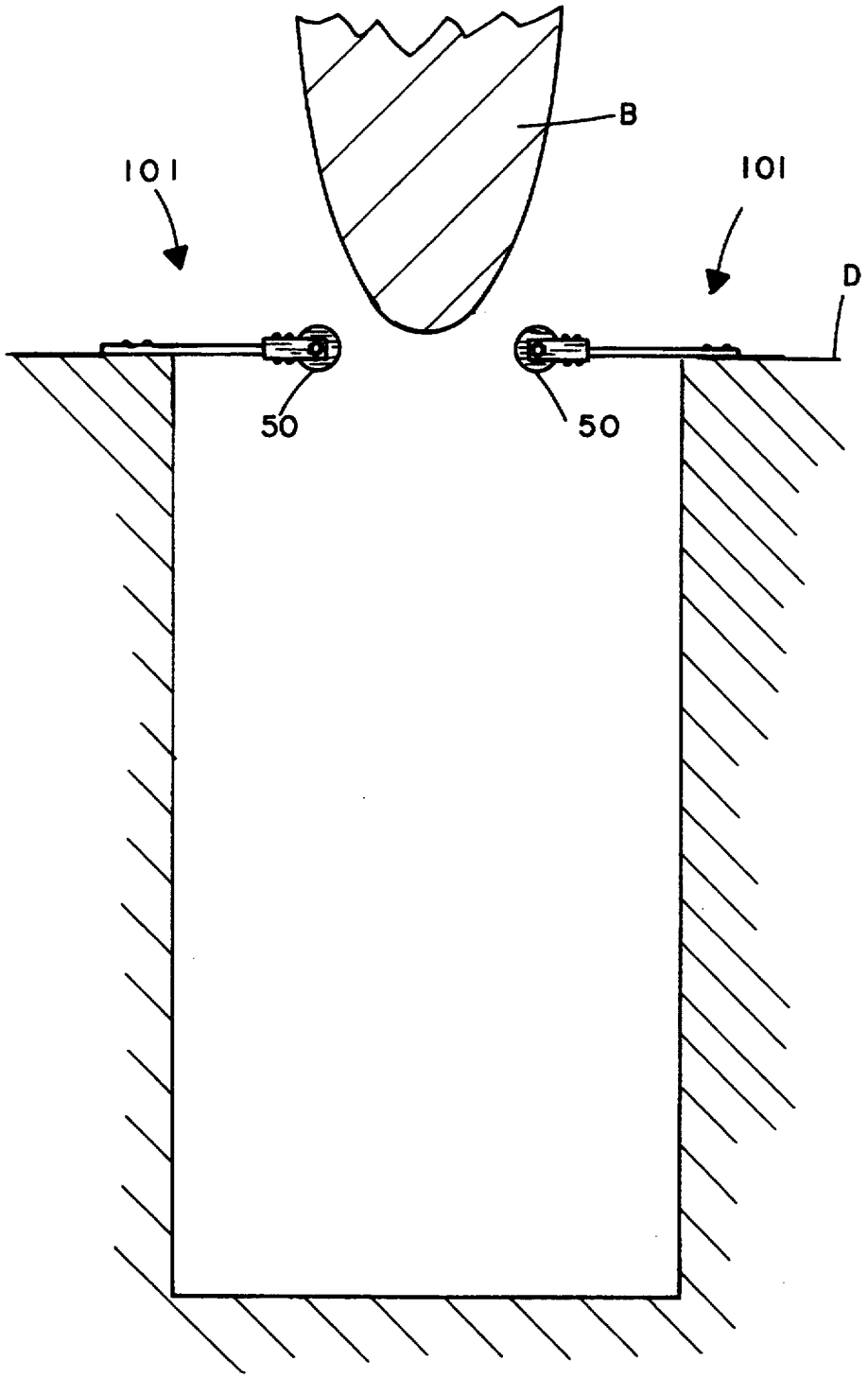
FIG. 7 is an environmental top plan view of a boat entering a dock with two docking devices according to a third embodiment of the invention.
Figure 9:
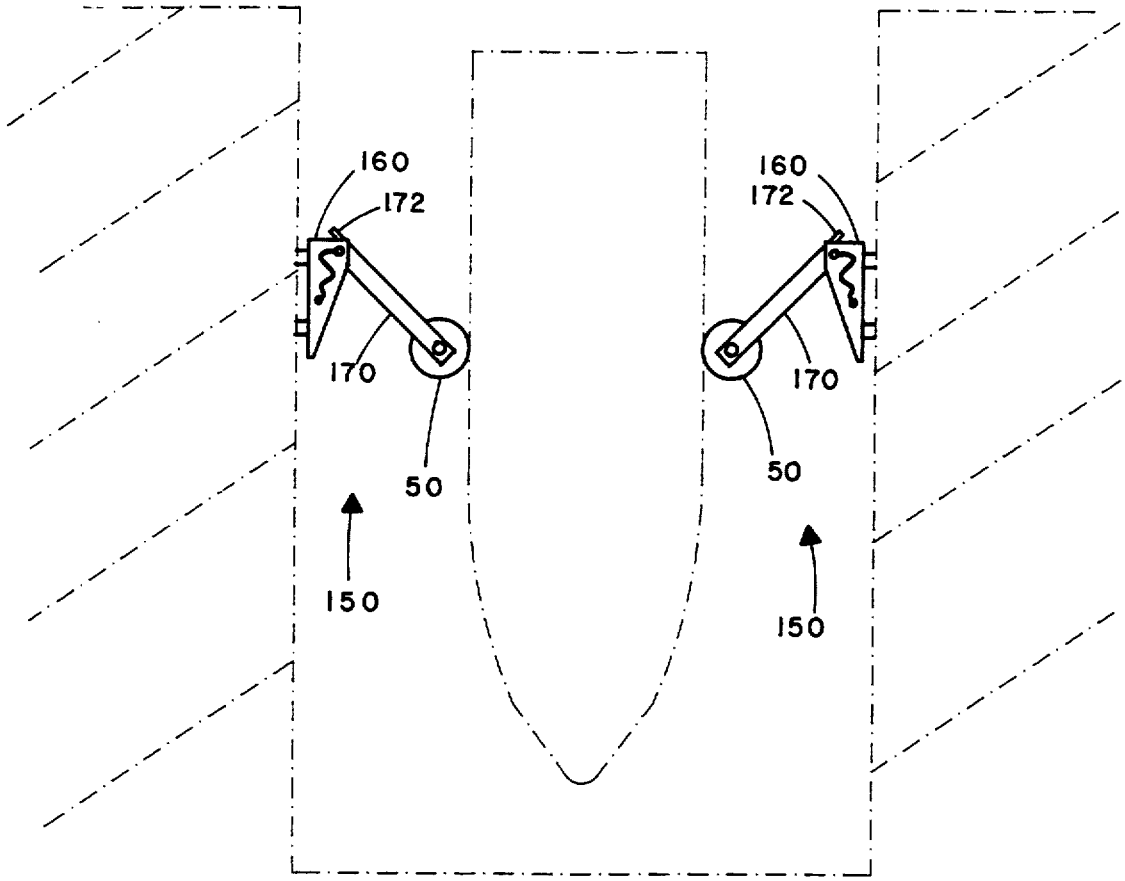
FIG. 9 is an environmental top plan view of a boat supported in a dock by two docking devices according to a fourth embodiment of the invention.
Figure 10:
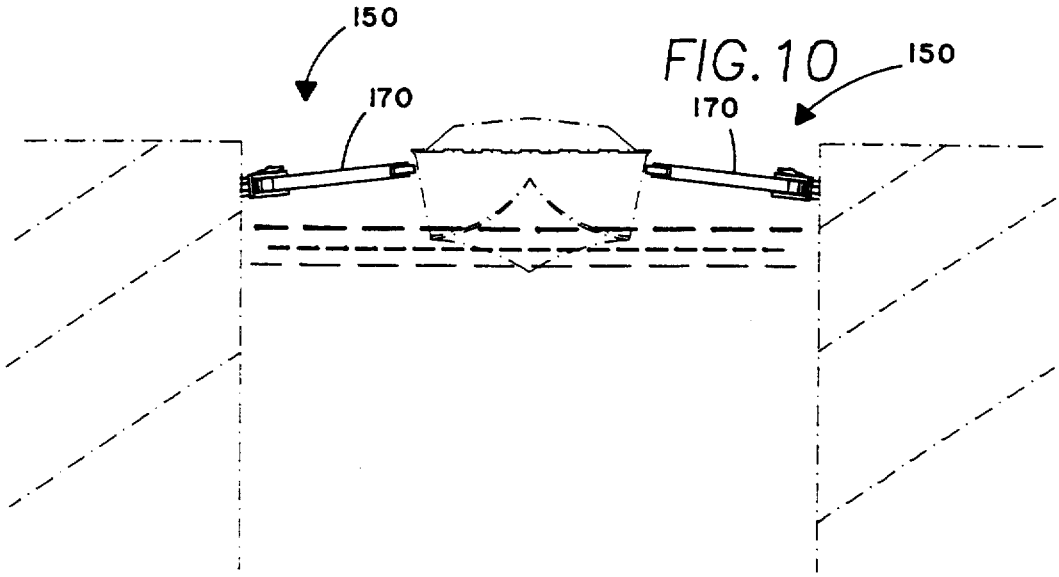
FIG. 10 is an environmental side view in elevation of a boat supported in a dock by the two docking devices of FIG. 9.
Figure 11:
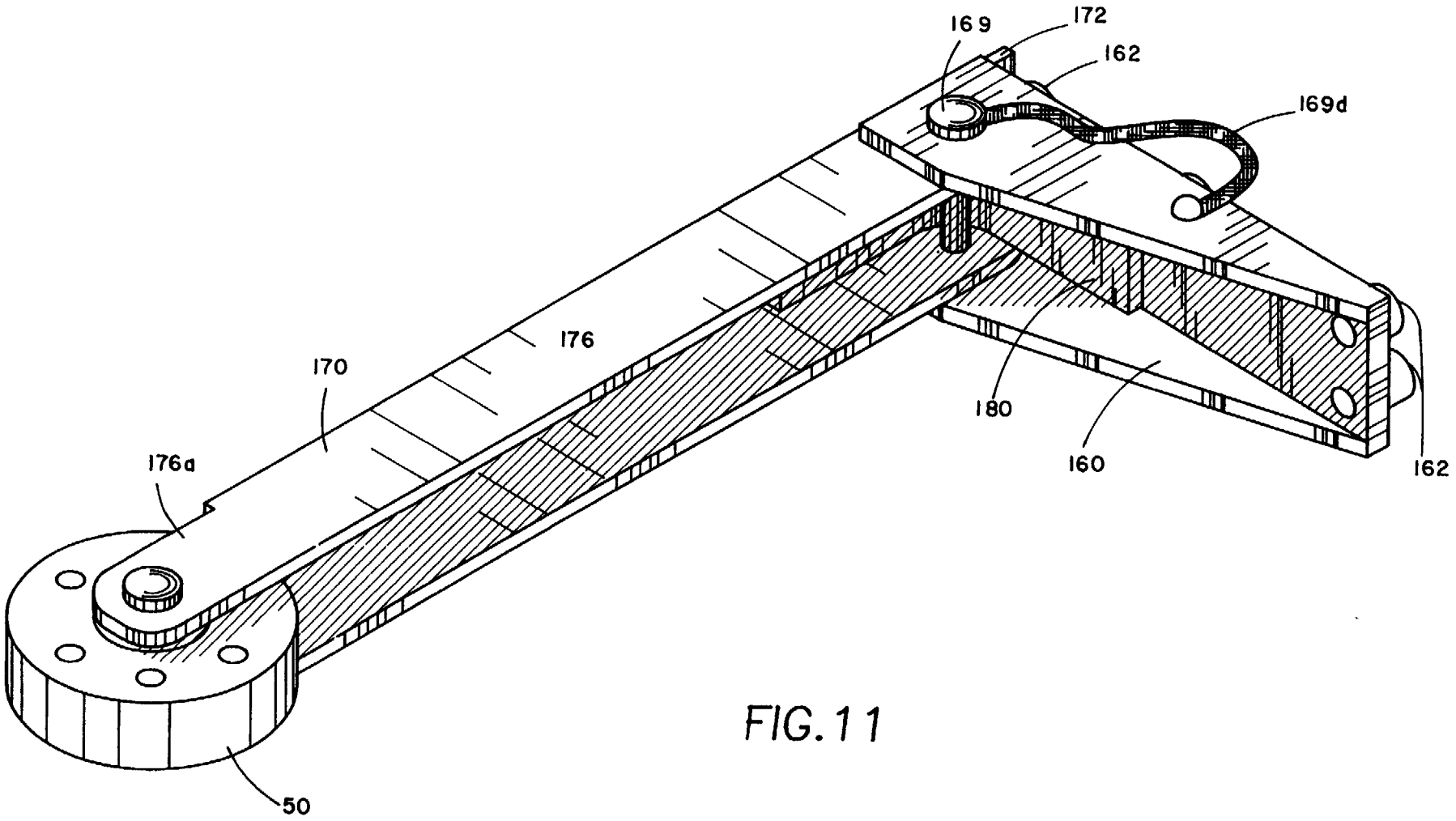
FIG. 11 is a rear perspective view of the docking device of FIG. 9.

FIG. 7 shows a boat B entering a dock D and prior to contact with two docking devices 101. Docking device 101 includes a vessel contacting element or wheel 50, which is retained between upper wheel holder 30 and lower wheel holder 40. Docking device 101 does not include an angled portion, as the spring element is substantially straight. Docking device 101 is advantageous in the event that there is a large difference between the width of the boat and the width of the dock.

FIGS. 9–14 show a preferred embodiment of a docking device 150 according to the invention. A boat may be located in a dock and in contact with two docking devices 150. Docking device 150 may include a vessel contacting element or wheel 50 and a pivot base 160 that is connected to a dock or supporting surface.

A pivot channel 170 may carry wheel 50 and rotate about pivot base 160. A spring 180 (see FIGS. 11 and 14) biases channel toward an extended position that is substantially orthogonal to pivot base 160. A motion limiter or stop 172 may be configured as a channel extension to limit the biasing motion of the spring.

Figure 12:
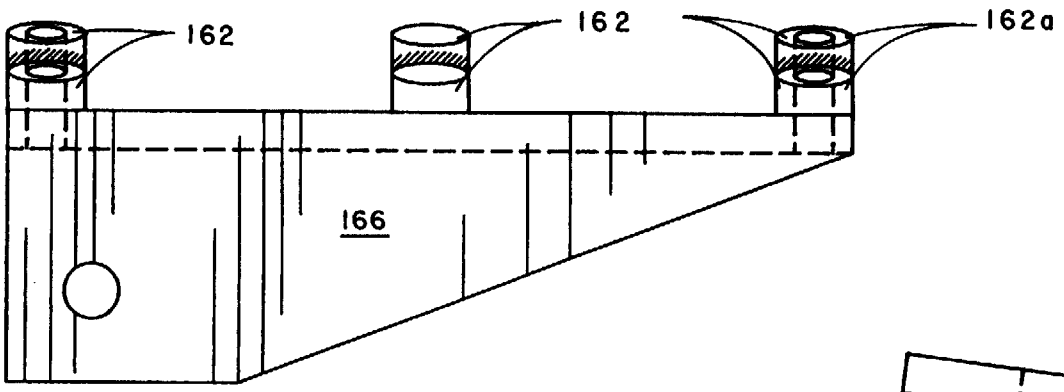
FIG. 12 is a top plan view of a pivot base of the docking device of FIG. 9.
Figure 13:
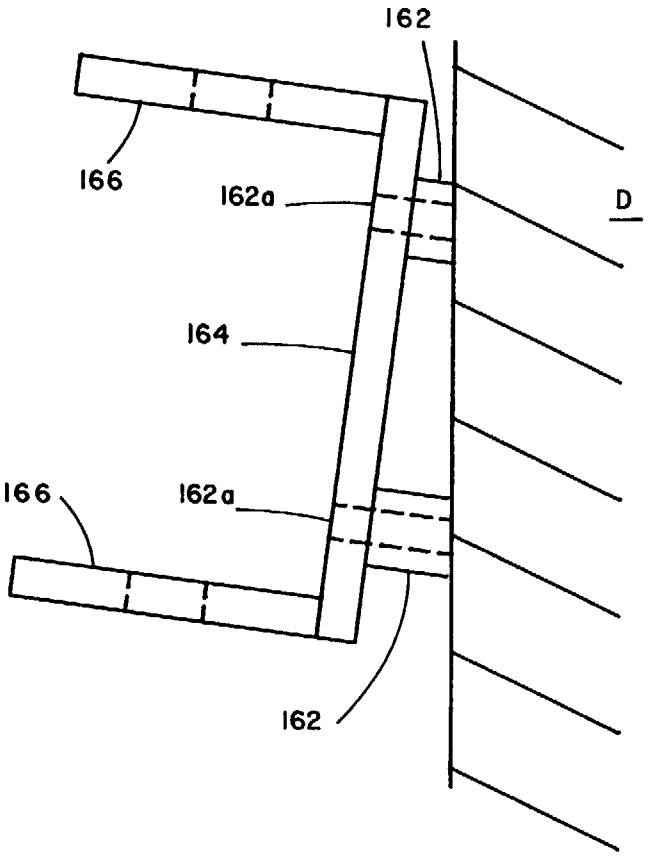
FIG. 13 is a side view in elevation of a pivot base of the docking device of FIG. 9.

FIGS. 12 and 13 show pivot base 160 in detail. According to the preferred embodiment, the pivot base exhibits a U-shaped profile including a base wall 164 and side walls 166 that are substantially perpendicular to the base wall. Six bosses 162 may be arranged on an exterior surface of the pivot base. Two or more of the bosses may define apertures 162*a* that accept lag bolts, screws or any other conventional fastener to secure the pivot base to a dock or supporting surface.

Each of bosses 162 may include an angled face so that wheel 50 and pivot channel 170 can extend out and contact the bow of a boat at an angle complementary to an angled surface of the bow of the boat. The instant inventor has determined that a horizontally directed docking device functions adequately in most docking situations, so an angle of 0° is appropriate in that instance. In other words, the face of the boss may be substantially parallel to an exterior surface of base wall 164.

The instant inventor has also noted that an excessive downward force may be generated on a horizontally directed docking device by an angled or curved surface of the hull of the boat. By properly angling the docking device ±10° from the horizontal to complement the curvature of the boat hull, an excessive downward force on the docking device by a boat during docking may be minimized or eliminated in most instances.

Figure 14:
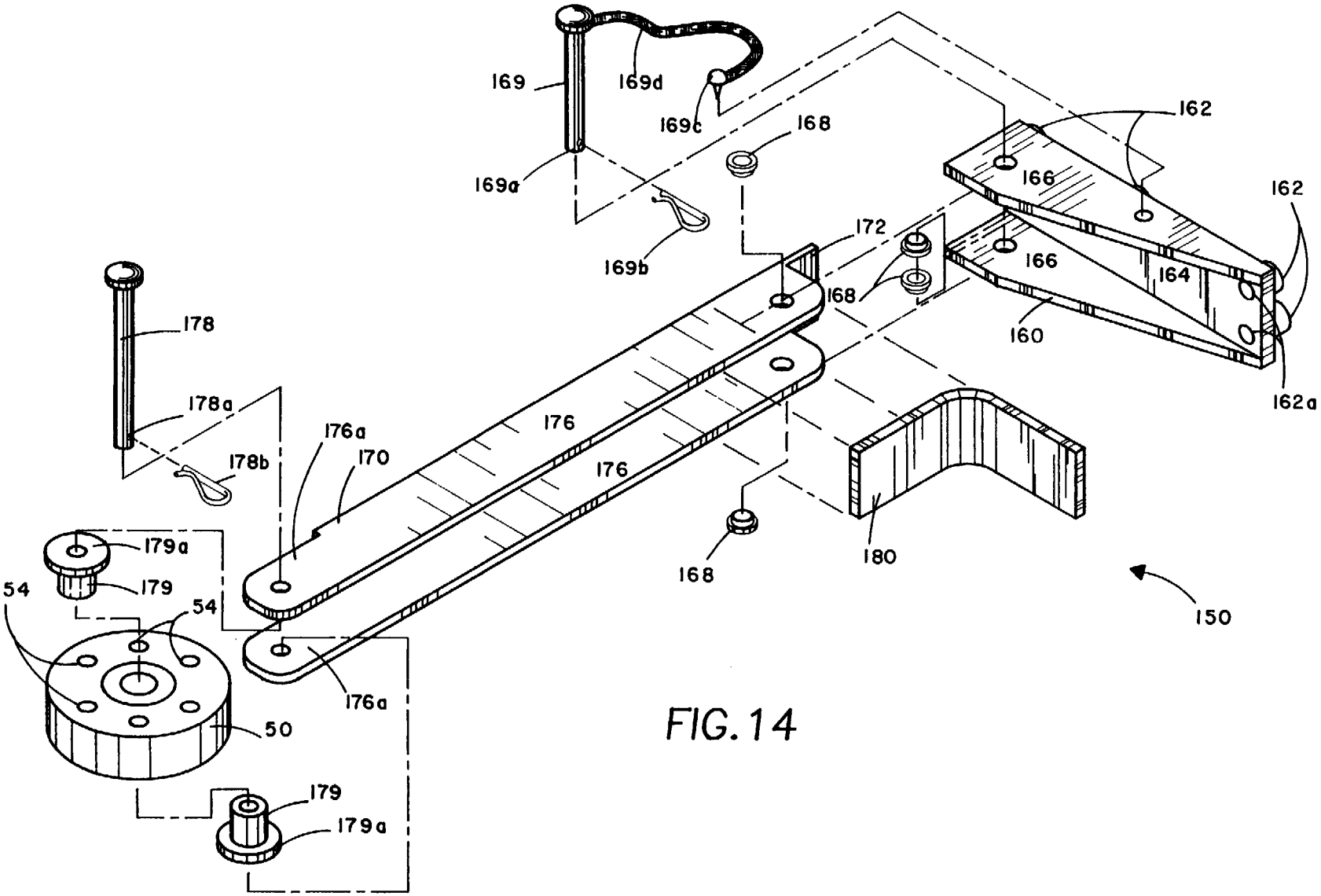
FIG. 14 is an exploded perspective view of the docking device of FIG. 9.

FIG. 14 shows an exploded perspective view of docking device 150 according to the invention. The components of the docking device may be made from polycarbonate or any other suitable material that is resistant to ultraviolet (UV) radiation, waterproof and salt-resistant. According to the preferred embodiment the components of the docking device are made from ultra-high molecular weight polyethylene (UHMW-polymer).

An information sheet dated Dec. 1, 1987 by The National Association of Plastics Distributors describes UHMW-polymer as having high abrasion and corrosion resistance. UHMW-polymer is ideal for the docking device, as it has a zero moisture absorption rating. Further, UHMW-polymer may be subjected to cryogenic temperatures without becoming brittle.

Spring element 180 includes a first leg that contacts the pivot base, a second leg that contacts the pivot channel and an angled portion or bend therebetween. A pair of split bushings 179 engage wheel 50. Flange 179*a* of the split bushing seats on a side wall extension 176*a* of side wall 176 of pivot channel 170. It is contemplated to form the split bushings from a less durable material than the wheel and pivot channel.

According to the invention, the split rings or bushings are designed to experience the most wear from the relative motion between the pivot channel and the wheel. This design feature is significant as the pivot channel and wheel are much more expensive to replace than the split bushings.

Likewise, paired bushings 168 are press fit into apertures in the pivot channel and pivot base, respectively. The paired bushings are deliberately redundant, i.e., four bushings are used instead of two, to minimize maintenance and replacement costs. The bushings are press fit so they move with the surrounding structures. Therefore, the bushings wear against each other, so the pivot base and pivot channel will not experience much wear. The bushings are designed to experience the most wear from the relative motion between the pivot channel and the pivot base. This design feature is significant as the pivot channel and the pivot base are much more expensive to replace than the bushings.

The docking device also includes pivot pin 169 having an aperture 169*a* that accepts a split pin or cotter pin 169*b* to retain the pivot pin within the pivot connection between the pivot base and the pivot channel. A self-tapping screw or other fastener 169*c* may be connected to the pivot base. A tether 196*d* may secure the pivot pin 169 to the pivot base, so the pivot pin is not easily lost.

Wheel pivot pin 178 may have an aperture 178*a* that accepts a split pin or cotter pin 178*b* to retain the pivot pin within the pivot connection between the wheel and the pivot channel. The pivot pins may be made of plastic, likely polycarbonate or UHMW-polymer. The pins are likely to see substantial wear from the pivoting movement and the bending stress of the free hanging pivot channel and the wheel. The invention has no metallic parts to reduce weight and minimize corrosion from water environment.

It is to be understood that the present invention is not limited to the preferred embodiments described above, but encompasses any and all embodiments within the scope of the following claims.

I claim:

1. A docking device for docking a boat comprising:

an angled spring element including a first leg, a second leg, and a bend therebetween;

a boat contacting member consisting of a wheel; and a holder connecting said wheel to said second leg of said spring element, said holder including a first wheel holding element connected to a first edge of said second leg and a second wheel holding element connected to a second edge of said second leg.

2. The docking device according to claim 1, wherein said first wheel holding element includes a bore for receiving a bolt, and said second wheel holding element includes a threaded bore for fastening the bolt.

3. The docking device according to claim 2, wherein said first wheel holding element includes a first slot for receiving said first edge of said second leg, said second wheel holding element includes a second slot for receiving said second edge said second leg.

4. The docking device according to claim 3, wherein said first wheel holding element, said second wheel holding element, and said second leg include connection bores for receiving pins.

5. A docking device for docking a boat comprising:

a pivot base;

a pivot arm;

an angled spring element biasing said pivot arm away from said pivot base, said spring element having a first leg, a second leg, and an angled sectino therebetween;

a boat contacting element consisting of a wheel connected to said pivot arm; and a pivot pin defining a pivot connection between said pivot base and said pivot arm, said pivot pin retaining said spring element against said pivot base and said pivot arm.

6. The docking device according to claim 5, wherein said pivot base includes a plurality of bosses configured so the docking device is connected to a dock or supporting surface.

7. The docking device according to claim 6, wherein each of said bosses on said pivot base include an angled face.

8. The docking device according to claim 7, wherein each of said angled faces of said bosses defines an angle from about $-10°$ to about $+10°$ relative to a horizontal plane.

9. The docking device according to claim 5, wherein said boat contacting element includes said wheel, a pair of split bushings capturing said wheel and a pivot pin passing through said split bushings, said pivot arm and said wheel.

10. The docking device according to claim 9, wherein said pivot pin passing through said split bushings includes an aperture configured to receive a split pin.

11. The docking device according to claim 5, wherein said pivot base includes a pair of bushings press fit into apertures within said pivot base, and said pivot arm includes a pair of bushings press fit into apertures within said pivot arm.

12. The docking device according to claim 5, wherein said pivot arm includes an extension configured to limit the pivoting motion of said pivot arm relative to said pivot base.

* * * * *